United States Patent [19]

Bamber et al.

[11] Patent Number: 4,574,536

[45] Date of Patent: Mar. 11, 1986

[54] ROOF TILE

[75] Inventors: Barry H. Bamber, Broughshane, Northern Ireland; George C. Brookhart, Jr.; Alan H. Sabatino, both of Littleton, Colo.

[73] Assignee: Oldcastle, Inc., Los Angeles, Calif.

[21] Appl. No.: 305,405

[22] Filed: Sep. 25, 1981

[51] Int. Cl.[4] ..... E04D 3/362

[52] U.S. Cl. ..... 52/125.3; 52/533; 52/536; 52/538; 206/322

[58] Field of Search ..... 52/518, 478, 521, 533, 52/534, 536, 538, 551, 553, 519, 558, 127.5, 125.3; D25/80, 90, 92; D92/29; 206/322

[56] References Cited

U.S. PATENT DOCUMENTS

| | | | |
|---|---|---|---|
| 146,140 | 1/1874 | Momenthy | 52/538 |
| 530,119 | 12/1894 | Niederlaender | 52/536 |
| 1,189,360 | 7/1916 | Guerini | 52/478 |
| 1,226,097 | 5/1917 | McLeod | 52/552 |
| 1,454,070 | 5/1923 | Openshaw | 52/538 |
| 1,531,887 | 3/1925 | Vermeulen | 52/543 |
| 1,999,244 | 4/1935 | Ludowici | 52/533 |
| 2,210,941 | 8/1940 | Leemhuis | 52/553 |
| 2,482,835 | 9/1949 | Bremer | 52/553 |
| 2,900,929 | 8/1959 | Adelt | 52/478 |

FOREIGN PATENT DOCUMENTS

| | | | |
|---|---|---|---|
| 3607 | of 1926 | Australia | 52/518 |
| 55497 | 5/1972 | Australia | 52/57 |
| 34921 | 5/1908 | Austria | 52/518 |
| 539600 | 11/1931 | Fed. Rep. of Germany | 52/536 |
| 2223529 | 10/1974 | France | 52/518 |
| 45738 | 12/1908 | Switzerland | 52/518 |
| 73261 | 12/1916 | Switzerland | 52/553 |
| 978577 | 12/1964 | United Kingdom | 52/536 |
| 1066332 | 4/1967 | United Kingdom . | |
| 1151722 | 5/1969 | United Kingdom . | |
| 1205567 | 9/1970 | United Kingdom . | |
| 2056525 | 3/1981 | United Kingdom . | |

*Primary Examiner*—John E. Murtagh

[57] ABSTRACT

A roof tile is provided with a pair of batten lugs and a pair of stacking lugs protruding from the bottom side thereof. The batten lugs are positioned very close to and taper to the edge at the head end of the tile so that the thickness of the tail end of the tile may be relatively thin and may be equal to the thickness at the edge of the tile head end. The stacking lugs are positioned longitudinally away from the tail end of the tile so as not to interfere with tile overlapping. The thickness of the tile from the front surface thereof to the tip of each batten lug is substantially equal to the thickness of the tile from the front surface thereof to the tip of each stacking lug such that the tile may be stacked with other similar tiles without need to rotate every other tile by 180°. The longitudinal position of the stacking lugs away from the tail end of the tile strengthens the tile and substantially inhibits breakage of the tile during shipping and handling, especially when stacked with other similar tiles. The roof tile is also provided with a wedge shaped protuberance for engaging a cable in a transport conveyer and restraining the same from movement laterally outwardly relative to the tile when the tile is carried on the cable.

20 Claims, 8 Drawing Figures

Fig. 3
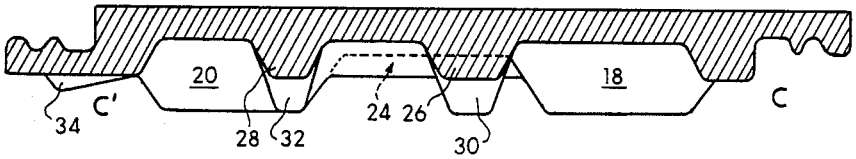
Fig. 4
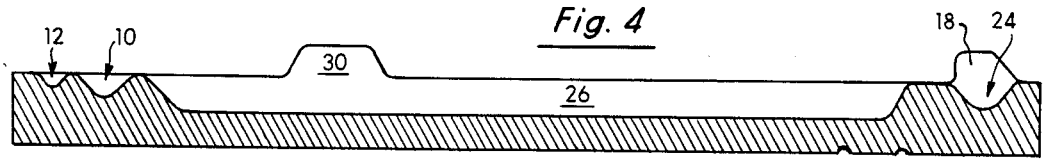
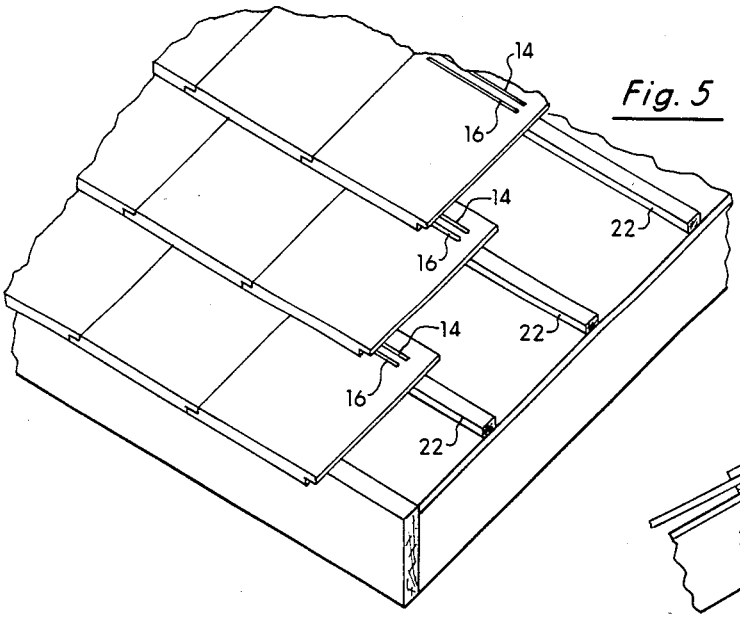
Fig. 5
Fig. 6
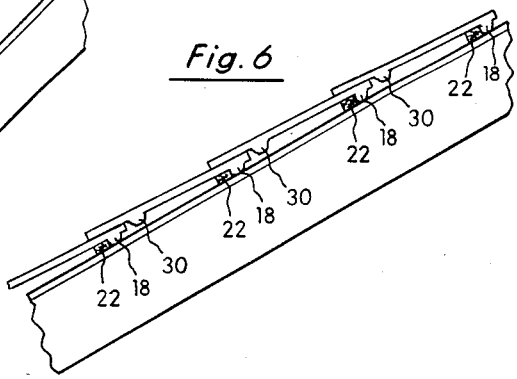
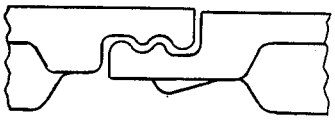
Fig. 7
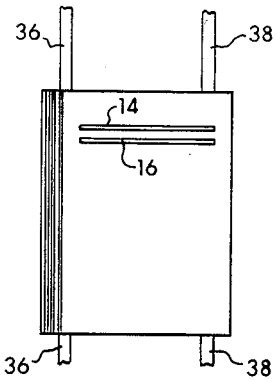
Fig. 8

ROOF TILE

BACKGROUND OF THE INVENTION

The present invention relates to a tile adapted to be mounted on a roof, especially an inclined roof, of a house or other building to protect the building against the effects of weather. The roof tile art is one of the oldest technologies known to man. Conventionally, roof tiles have been manufactured by filling a pallet or mold configured in the shape of the tile with fluid material of which the tile is composed. The material hardens, and the hard tile is removed from the pallet.

In a modern, yet common, automated process for manufacturing such tiles, empty pallets are lined end-to-end in an abutting relationship along a conveyer transport. The pallets are sequentially passed into an extruder whereat the fluid material such as concrete is poured into each pallet. The material is in a so called "wet" state, and as the pallets containing the wet material pass out of the extruder, a guillotine or other cutting means severs the wet material in adjacent pallets along the abutting edges of the pallets. Thereafter, the individual pallets having the wet material therein are removed from the conveyer transport and are stored in a curing chamber. After the material is sufficiently cured, the individual pallets containing the dry, hard, cured material therein are placed on the conveyer transport and are carried by the transport to a station having means for separating each pallet from the dry, hardened, cured material therein. After passing through such station, the empty pallets are carried by the conveyer transport to the entrance of the extruder, and the dry, hardened, cured material comprising a tile is carried by separate conveyer transport means to a station whereat the tiles are stacked in a pre-determined number and the stack of tiles is wrapped or bound with plastic banding or the like. Thereafter, each bound stack of tiles is transported with a fork lift or the like to a tile yard or tile holding area where it is stored and then sometime later is delivered by a truck or a railroad car to a customer.

Many roof tiles, including most flat roof tiles, conventionally have been made with a pair of laterally spaced batten lugs protruding from near one end thereof. When stacking such tiles, it is necessary to rotate every other plate by 180° so that the tiles will not tilt with respect to each other, which might undesirably cause tiles to slide or topple from the stacked formation. The function of rotating every other tile during the stacking operation heretofore has involved manual handling and the attendant time delays and increased cost associated therewith or has involved relatively expensive and complex machinery. Moreover, many tiles stacked in such a manner are structurally weak in the region midway between the ends of the tile, which results in a significant number of the tiles being cracked or broken during shipping and handling of the stacks. Other tiles are provided with extra material to strengthen the midsection region.

The present invention was developed primarily as a result of efforts to overcome the problems and costs associated with stacking, handling and shipping of such conventional tiles. However, the present invention is also directed to features that are not principally directed to overcoming these problems.

A patentability search was conducted for the present invention, and the results of that search are discussed in a prior art statement accompanying this patent specification. In the prior art statement, the Patent Examiner has been requested to make his own independent investigation as to the relevancy of the art discussed therein to the present invention.

SUMMARY OF THE INVENTION

Briefly, the present invention is directed to a roof tile which may be easily and securely stacked without rotation of every other tile by 180° and which is relatively structurally strong throughout the entire length of the tile, thereby inhibiting damage to the tile during shipping and handling thereof. Another aspect of the invention is directed to a tile feature for maintaining the tile on the conveyer transport means during the manufacture thereof.

In accordance with one embodiment of the present invention, a flat, low-pitch roof tile is provided with a pair of conventional, laterally spaced batten lugs on the bottom side thereof and positioned near the head end thereof and is provided with a pair of laterally spaced stacking lugs on the bottom side thereof and positioned generally two-thirds of the distance from the batten lugs to the tail end of the tile. The thickness of the tile from the surface of the front side thereof to the tip of each batten lug is substantially equal to the thickness of the tile from the surface of the front side thereof to the tip of each stacking lug. Consequently, the tiles of this construction may be stacked one on top of another without the need of rotating every other one by 180°. Also, the positioning of the stacking lugs away from the tail end thereof adds to the structural strength of the tile both in the region intermediate the tile ends and in the region of the tile tail end and thereby inhibits cracking and breaking of stacked tiles during shipping and handling thereof. Moreover, such positioning of the stacking lugs away from the tail end of the tile permits the tile to be mounted on a roof such that the tail end of the tile overlaps the head end of another tile without the stacking lugs interfering with the overlapping. Because the overlapping tile regions may abut, weather elements are inhibited from passing between the overlapping regions.

The batten lugs provided on the roof tile of one embodiment of the present invention are positioned closer to the edge of the head end thereof than in previous tile constructions. The batten lugs are positioned near, but not at, the edge of the head end such that each lug tapers to the edge of the head end. Since it is desirable that the tail end be relatively thin and since it is desirable that the tail end edge and the head end edge are of equal thickness for facilitating the severing or quillotine operation during the manufacture of the tiles, such positioning of the batten lugs still permits the tile tail end to be relatively thin.

The tile is customarily mounted on a roof by a nail or the like extending through the tile in a region just below the batten lugs. The nail often extends through conventional tiles in the region of capillary grooves in the surface of the front side of the tile, the function of which is to prevent water from seeping upwardly between overlapping tiles through capillary action. Consequently, in conventional tiles, the nail placement often interferes with the optimal functioning of the capillary grooves. The decreased spacing between the batten lugs and the head end edge according to one embodiment of the present invention permits the mounting nail to extend through the tile of the present invention above the capillary grooves, without adversely affecting the functioning of the capillary grooves.

In yet another embodiment of the present invention, the roof tile is provided with a wedge shaped projection on the bottom side thereof and near a lateral edge thereof. When the tile is carried by a conveyer transport comprising a pair of spaced cables, relative movement of a cable toward the lateral edge of the tile, which might cause the tile to topple from the conveyer transport, is inhibited by the wedge shaped projection.

BRIEF DESCRIPTION OF THE DRAWINGS

The details of the present invention are described with respect to the accompanying drawings, wherein:

FIG. 3 is a cross-sectional view of the roof tile shown in FIG. 2 as would be taken along the line A—A;

FIG. 4 is a cross-sectional view of the roof tile shown in FIG. 1 as would be taken along the line B—B;

FIG. 5 is a sectional plan view of an inclined roof having a plurality of the roof tiles shown in FIG. 1 mounted thereon;

FIG. 6 is a side view of the roof and mounted roof tiles shown in FIG. 5;

FIG. 7 is a sectional end view of two interlocking lateral edges of two adjacent roof tiles such as shown in FIG. 1; and FIG. 8 is a top view of the roof tile shown in FIG. 1 carried on a transport conveyer comprising a pair of laterally spaced, endless polycord cables.

DESCRIPTION OF A PREFERRED EMBODIMENT

Figure 2:
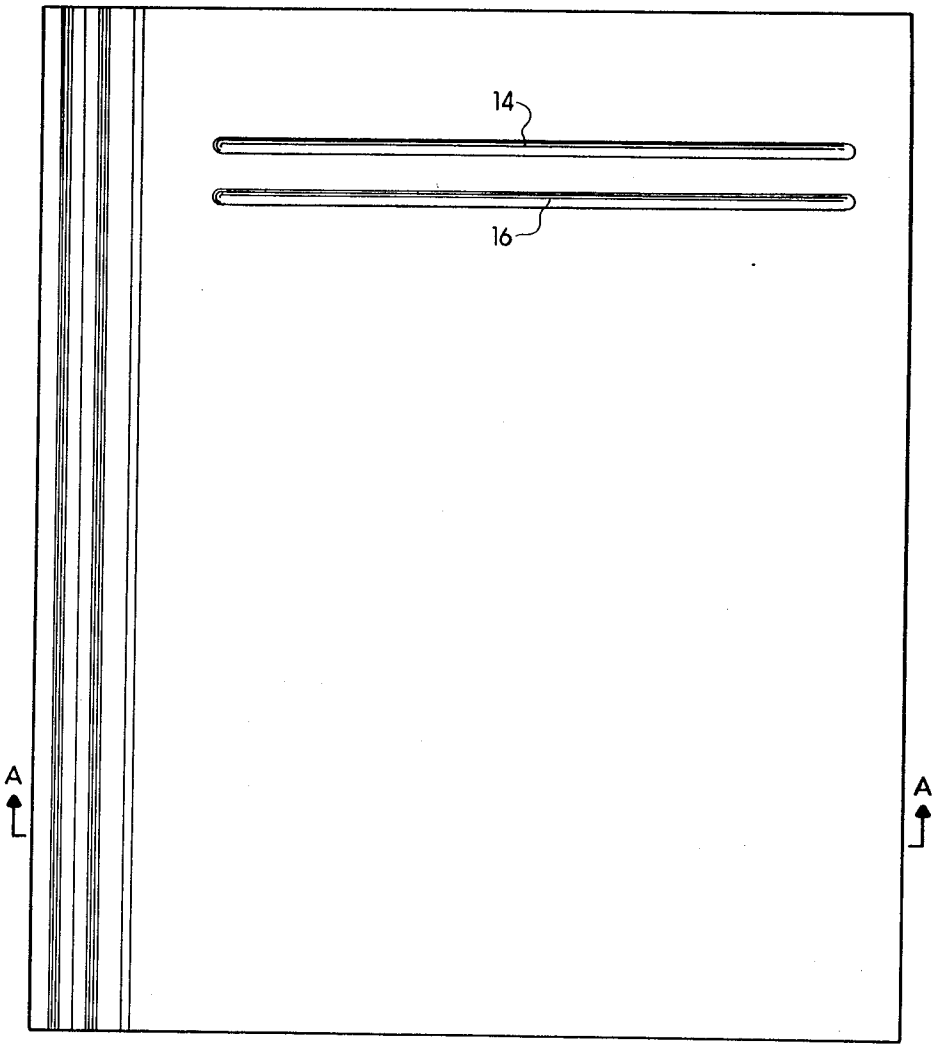
FIG. 2 is a top view of the roof tile shown in FIG. 1.
Figure 1:
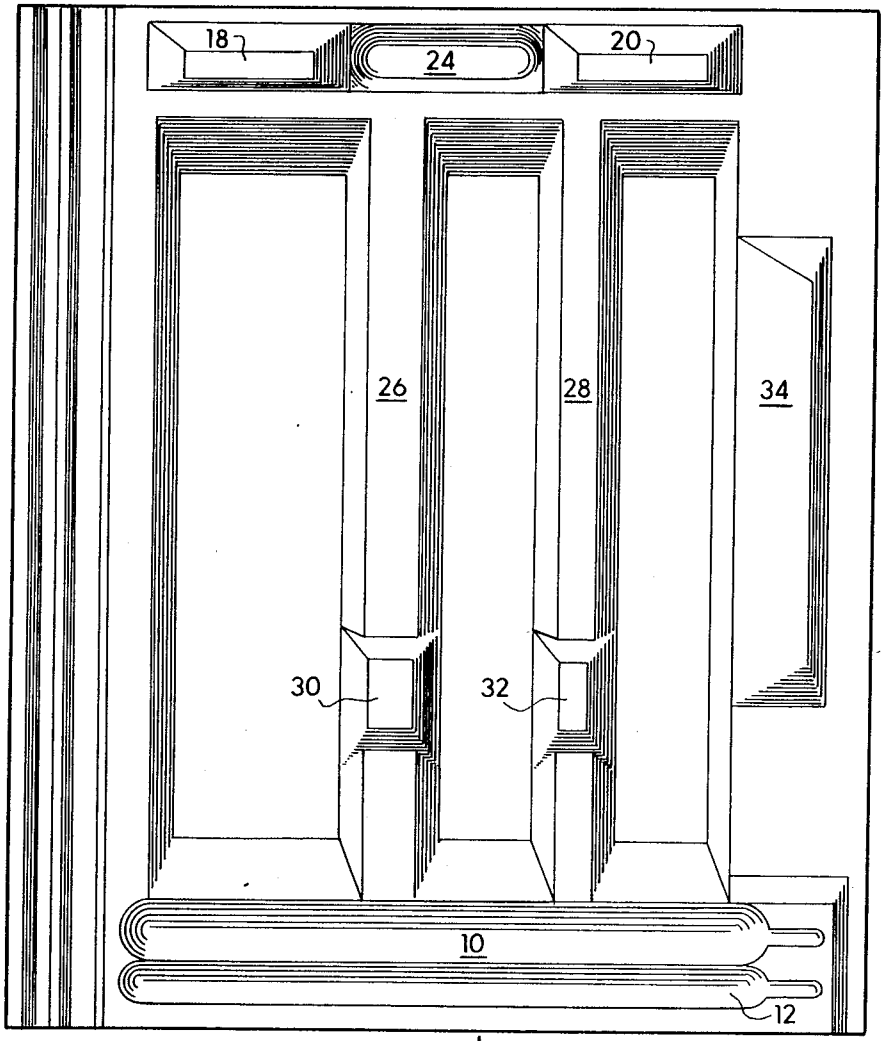
FIG. 1 is a bottom view of a flat, low-pitch roof tile constructed according to an embodiment of the present invention.

Referring now to the drawings wherein like reference numerals and symbols refer to the same item, there is shown in FIGS. 1 through 4, a flat, low-pitch roof tile constructed according to a preferred embodiment of the present invention. Preferably the tile is formed of concrete. The roof tile is generally flat and rectangular and has a top side as shown in FIG. 2 which is substantially planar and has a bottom side as shown in FIG. 1. The upper longitudinal end of the roof tile is commonly known as the head end, and the lower longitudinal end of the roof tile is commonly known as the tail end. When the roof tile is mounted on an inclined roof, the head end thereof is normally disposed upslope of the tail end thereof, with the tail end thereof overlapping the head end of a lower, adjacent roof tile.

As shown in FIG. 1, the surface of the bottom side of the roof tile is provided with a pair of capillary grooves 10, 12 laterally extending across substantially the entire width of the tile near the tail end thereof. A corresponding pair of capillary grooves 14, 16 is provided in the surface of the top side of the roof tile laterally extending across substantially the entire width of the tile near, yet spaced from the tile edge at the head end thereof. The location of each pair of capillary grooves is selected such that when tiles of this construction are placed in an overlapping relation as described above, the capillary grooves 10, 12 on the bottom side of the overlapping tile will overlie the capillary grooves 14, 16 on the top side of the overlapped tile. As is commonly known in the art, any number of capillary grooves may be utilized, and capillary grooves may be provided on only one side of the roof tile.

Each lateral edge of the roof tile is conventionally shaped as one-half of the interlocking, form fitting coupling. As most clearly depicted in FIG. 3 and FIG. 7, the lateral edge of each tile is designed to interlock in a formfit manner with the adjacent lateral edge of an adjacent tile when mounted on a roof. The interlocking feature of the tile adds strength to the tile when it is interlocked with another tile, aids in maintaining the interconnected tiles in proper alignment with respect to each other, and inhibits water and other weather elements from passing between the adjacent tiles.

A pair of laterally spaced batten lugs 18, 20 are provided on the bottom side of the tile along the head end thereof. As is commonly known in the art, the batten lugs 18, 20 are adapted to engage a batten strip 22 affixed to a roof thereby to suspend the tile from the batten strip 22 and thereby to maintain the roof tile in a selected position on the roof. The batten strip 22 is positioned on the side of the batten lugs away from the edge at the tile head end, as is illustrated in FIG. 6. Although a pair of batten lugs 18, 20 is illustrated in the drawings, it should be understood that any number of batten lugs may be utilized in accordance with the present invention. In the region between the laterally spaced batten lugs 18, 20, the surface of the bottom side of the roof tile is provided with a depression 24 therein for use as a fingerhold to facilitate the manual handling of the tile.

The batten lugs 18, 20 of the present invention are positioned closer to the edge at the tile head end than previously. The batten lugs 18, 20 are very slightly spaced from and taper to such edge, as is shown most clearly in FIG. 4. It is important that the tile edge at the tail end thereof and the tile edge at the head end thereof be of the same thickness in order to facilitate the clean severance of the tile by a guillotine or the like during the manufacture thereof. It is also important that the tail end of the tile be as thin as reasonably possible so that it will not jut far above an overlapped tile. Thus, the positioning of the batten lugs 18, 20 very close to the edge at the tile head end permits the tile tail end (and the edge at the tile head end) to be relatively thin and permits the clean severance of the tile during the manufacturing thereof. Moreover, such positioning of the batten lugs 18, 20 permits a mounting nail to extend through the tile in a region between the batten lugs 18, 20 and the aforesaid capillary grooves whereby the nail does not interfere with the functioning of the capillary grooves 14, 16. For mounting the tile on a roof, the tile may be provided with one or more holes extending therethrough (not shown) within the region between the batten lugs 18, 20 and the aforesaid capillary grooves 14, 16 for insertion of a nail or the like therethrough and into a batten strip 22 or the like.

As shown in FIG. 1 and FIG. 3 the interior portion of the bottom side of the roof tile, away from the edges thereof, is recessed to decrease the weight of the tile and to decrease the amount of the material necessary to make the tile. A pair of laterally spaced ridges 26, 28 longitudinally extend through the recessed area. The longitudinal ridges 26, 28 are provided for the purpose of strengthening the tile. The center-most ridge 26 is slightly wider than the other longitudinal ridge 28. A stacking lug 30, 32 is provided on each of the longitudinal ridges 26, 28. As shown in FIG. 3 and FIG. 4, the thickness of the tile from the surface on the top side thereof to the free tip of each stacking lug 30, 32 is substantially equal to the thickness of the tile from the surface of the top side thereof to the free tip of each batten lug 18, 20. Such thickness is the greatest thickness of the tile. It will thus be appreciated that when a plurality of tiles constructed according to the present invention are stacked one on top of another, the tiles will contact each other through the tips of the batten lugs 18, 20 and the tips of the stacking lugs 30, 32. Also, the tiles may be stacked securely without rotating every other tile by 180° so that the head ends of all of the stacked tiles may be positioned along one edge of the stack and so that the plane in which the lower-most tile is generally oriented is substantially parallel to each of the planes in which each of the other stacked tiles is generally oriented.

Although a pair of stacking lugs 30, 32 mounted on longitudinal ridges 26, 28 has been described and illustrated herein, it should be understood that any number of stacking lugs may be utilized in accordance with the present invention and that the stacking lugs need not be mounted on ridges or the like. Preferably, however, a pair of laterally spaced stacking lugs or a single laterally elongated stacking lug is utilized to provide the greatest strength and balance for the tile.

The longitudinal positioning of the stacking lugs 30, 32 is also a feature of the present invention. In a preferred embodiment, the tile length is approximately 420 millimeters, the center point of each batten lug 18, 20 is approximately 28.5 millimeters from the edge at the tile head end, and the center point of each stacking lug 30, 32 is approximately 127.5 millimeters from the edge at the tile tail end. Thus, the stacking lugs 30, 32 are approximately one-third of the distance between the edge at the tile tail edge and the batten lugs 18, 20. It is believed that such relative longitudinal position of the stacking lugs 30, 32 adds greatly to the strength of the tile in its mid area as well as in its tail end area. Consequently, when a tile of this construction is stacked, the tile is capable of withstanding relatively great weight and stress compared to previous tiles, thereby substantially inhibiting cracking or breaking of the tile during shipping and handling thereof, especially when the tile is stacked with other tiles. It should also be noted that such relative longitudinal positioning of the stacking lugs 30, 32 permits the tail end of the tile to overlap the head end of another tile without interference by the stacking lugs 30, 32, as illustrated in FIG. 6. It should be further understood that the relative longitudinal position of the stacking lugs 30, 32 may be other than that particularly described above, however, it is believed that these other relative longitudinal positions are less preferred. Consequently, for example, the ratio of the distance between the stacking lugs 30, 32 and the edge at the tile tail end to the distance between the batten lugs 18, 20 and the edge at the tile tail end may be within the range of one-fifth to five-eighths.

Another feature of the present invention is the provision of a longitudinally extending, substantially wedge shaped protuberance 34 on the bottom side of the roof tile near a lateral edge thereof, as illustrated in FIG. 1 and FIG. 3. The wedge shaped protuberance 34 is utilized to ensure that the tile does not topple from a conveyer transport or the like during the manufacturing of the tile when the conveyer transport is subjected to vibrations, jostling, etc. The wedge shaped protuberance 34 is especially adapted for use in a transport conveyer comprising a pair of spaced polycord cables 36, 38. As best shown in FIG. 3 and FIG. 8, the tile is placed on the cables 36, 38 such that the bottom side of the tile is facing the cables and such that each cable is positioned below and along a corresponding edge of the tile. As shown in FIG. 3, one of the cables 38 is disposed in the region designated C, where it engages the tile in the region of one-half of the interlocking coupling. Because of the various depressions and ridges comprising such coupling half, and because of the weight of the tile upon the cable 38, the cable 38 in the region designated C is inhibited from movement laterally relative to the tile. The other polycord cable 36 is positioned in the area designated C′ as shown in FIG. 3. The wedge shaped protuberance 36 engages the polycord cable 36 and substantially inhibits the same from moving laterally outwardly relative to the tile, which movement might result in the tile being unsupported by the cable and toppling from the transport conveyer. In this particular embodiment of the tile, the cable 36 is also substantially inhibited from movement laterally inwardly relative to the tile by one of the batten lugs 20.

Although particular embodiments of the present invention have been described and illustrated herein, it should be recognized that modifications and variations may readily occur to those skilled in the art and that such modifications and variations may be made without departing from the spirit and scope of our invention. Consequently, our invention as claimed below may be practiced otherwise than as specifically described above.

We claim:

1. A roof tile having a substantially flat top side and bottom side and having a head end and a tail end and provided with at least one batten lug protruding from the bottom side and located near an edge at the tile head end and provided with at least one stacking lug protruding from the bottom side and located between the batten lug and an edge at the tile tail end, the thicness of the tile at the tile tail end edge being substantially thinner than the thickness of the tile measured from the surface of the top thereof to the tip of the stacking lug, the thickness of the tile measured from the surface of the tope side thereof to the tip of the batten lug being substantially equal to the thickness of the tile measured from the surface of the top side thereof to the tip of the stacking lug, such that when a plurality of such tiles are stacked one on top of another with the head ends thereof positioned along one side of the stack and the tail ends thereof positioned along another side of the stack, and plane in which the lowermost tileis generally oriented is substantially parallel to the plane in which the uppermost tile is generally oriented.

2. A roof tile according to claim 1 wherein the ratio of the distance between the stacking lug and the edge at the tile tail end to the distance between the batten lug and the edge at the tile tail is within the range of one-fifth to five-eighths.

3. A roof tile according to claim 2 wherein the ratio is approximately one-third.

4. A roof tile according to claim 1 wherein the tile extends longitudinally between the head end thereof and the tail end thereof and wherein the tile is provided with a pair of laterally spaced batten lugs and wherein the tile surface generally between the batten lugs is provided with a depression therein for use as a fingerhold to facilitate handling of the tile.

5. A roof tile according to claim 1 wherein the edge at the head end thereof is substantially as thick as the edge at the tail end thereof.

6. A roof tile according to claim 5 wherein the batten lug tapers to the edge at the head end thereof.

7. A roof tile according to claim 1 wherein the tile extends longitudinally between the head end thereof and the tail end thereof and wherein the tile is provided with at least one groove generally laterally extending across the surface at the top side thereof and generally longitudinally spaced from the batten lug such that a nail or the like may extend through the tile in the region between the groove and the batten lug to secure the tile to a batten or the like.

8. A roof tile according to claim 7 provided with only one hole therethrough in the region between the groove and the batten lug for the reception of a nail or the like.

9. A roof tile according to claim 1 adapted for positioning on a roof next to another tile such that the tail end of the tile overlaps the head end of the other tile. wherein the stacking lug provided on the tile is located so as to be in a non-overlapping relation with the other tile.

10. A roof tile according to claim 3 adapted for positioning on a roof next to another tile such that the tail end of the tile overlaps the head end of the other tile and wherein the stacking lug provided on the tile is located so as to be in a non-overlapping relation with the other tile.

11. A roof tile according to claim 1 wherein the tile extends longitudinally between the head end thereof and the tail end thereof and wherein substantially all of the interior area of the surface of the bottom side thereof, away from the edges thereof, is recessed, and wherein at least one ridge longitudinally extends through the recessed interior area and wherein the stacking lug is mounted on the ridge.

12. A roof tile according to claim 1 adapted to be carried on a plurality of cables wherein the tile is provided with a substantially wedge shaped protuberance for engaging a cable and for maintaining the cable beneath the tile.

13. A roof tile having a top side and a bottom side and having a head end and a tail end and provided with at least one batten lug protruding from the bottom side and located near an edge at the tile head end and provided with at least one stacking lug protruding from the bottom side and located between the batten lug and an edge at the tile tail end, the thickness of the tile at the tile tail end edge being substantially thinner than the thickness of the tile measured from the surface of the top thereof to the tip of the stacking lug, the thickness of the tile measured from the surface of the top side thereof to the tip of the batten lug being substantially equal to the thickness of the tile measured from the surface of the top side thereof to the tip of the stacking lug, such that when a plurality of such tiles are stacked one on top of another with the head ends thereof positioned along one side of the stack and the tail ends thereof positioned along another side of the stock, the plane in which the lowermost tile is generally oriented is substantially parallel to the plane in which the uppermost tile is generally oriented, said tile longitudinally extending between the head end thereof and the tail end thereof and provided with at least one groove generally laterally extending across the surface at the top side thereof and generally longitudinally spaced from the batten lug and further provided with a hole therethrough in the region between the groove and the batten lug for the reception of a nail or the like to extend through and secure the tile to a batten or the like.

14. A roof tile according to claim 13 wherein the ratio of the distance between the stacking lug and the edge at the tile tail end to the distance between the batten lug and the edge at the tile tail is within the range of one-fifth to five-eighths.

15. A roof tile according to claim 13 wherein the edge at the head end thereof is substantially as thick as the edge at the tail end thereof.

16. A roof tile according to claim 13 adapted for positioning on a roof next to another tile such that the tail end of the tile overlaps the head end of the other tile and wherein the stacking lug provided on the tile is located so as to be in a non-overlapping relation with the other tile.

17. A roof tile according to claim 13 wherein the tile extends longitudinally between the head end thereof and the tail end thereof and wherein substantially all of the interior area of the surface of the bottom side thereof, away from the edges thereof, is recessed, and wherein at least one ridge longitudinally extends through the recessed interior area and wherein the stacking lug is mounted on the ridge.

18. A roof tile having a top side and a bottom side and having a head end and a tail end and provided with at least one batten lug protruding from the bottom side and located near an edge at the tile head end and provided with at least one stacking lug protruding from the boftom side and located between the batten lug and an edge at the tile tail end, the thickness of the tile at the tile tail end edge being substantially thinner than the thickness of the tile measured from the surface of the top thereof to the tip of the stacking lug, the thickness of the tile measured from the surface of the top side thereof to the tip of the batten lug being substantially equal to the thickness of the tile measured from the surface of the top side thereof to the tip of the stacking lug, such that when a plurality of such tiles are stacked one on top of another with the head ends thereof positioned along one side of the stack and the tail ends thereof positioned along another side of the stack, the plane in which the lowermost tile is generally oriented is substantially parallel to the plane in which the uppermost tile is generally oriented, said tile extending longitudinally between the head end thereof and the tail end thereof and wherein substantially all of the interior area of the surface of the bottom side thereof, away from the edges thereof, is recessed, and wherein at least one ridge longitudinally extends through the recessed interior area and wherein the stacking lug is mounted on the ridge.

19. A roof tile according to claim 18 adapted for positioning on a roof next to another tile such that the tail end of the tile overlaps the head end of the other tile and wherein the stacking lug provided on the tile is located so as to be in a non-overlapping relation with the other tile.

20. A roof tile having a top side and a bottom side and having a head end and a tail end and provided with the least one batten lug protruding from the bottom side and located near an edge at the tile head end and provided with at least one stacking lug protruding from the bottom side and located between the batten lug and an edge at the tile tail end, the thickness of the tile at the tile tail end edge being substantially thinner than the thickness of the tile measured from the surface of the top thereof to the tip of the stacking lug, the thickness of the tile measured from the surface of the top side thereof to the tip of the batten lug being substantially equal to the thickness of the tile measured from the surface of the top side thereof to the tip of the stacking lug, such that when a plurality of such tiles are stacked one on top of another with the head ends thereof positioned along one side of the stack and the tail ends thereof positioned along another side of the stack, the plane in which the lowermost tile is generally oriented is substantially parallel to the plane in which the uppermost tile is generally oriented, said tile longitudinally extending between the head end thereof and the tail end thereof and provided with a pair of laterally spaced batten lugs and wherein the tile surface generally between the batten lugs is provided with a depression therein for use as a fingerhold to facilitate handling of the tile.

* * * * *